United States Patent [19]

Minor

[11] Patent Number: 4,713,274

[45] Date of Patent: Dec. 15, 1987

[54] PAD OF SHEETS FOR REMOVING PARTICULATE MATTER

[76] Inventor: Cathy L. Minor, 7503 Constitution Dr., Cincinnati, Ohio 45215

[21] Appl. No.: 897,622

[22] Filed: Aug. 18, 1986

[51] Int. Cl.[4] ..... B32B 3/06; B32B 7/06

[52] U.S. Cl. ..... 428/40; 428/43; 428/192; 428/194; 206/813; 281/15 R

[58] Field of Search ..... 428/40–42, 428/43, 192, 352, 354, 194; 281/15 R, 18, 16, 15 B; 206/484, 813, 820

[56] References Cited

U.S. PATENT DOCUMENTS 2,391,539 12/1945 Avery ..... 428/42 X
4,596,407 6/1986 Suska ..... 281/15 R

FOREIGN PATENT DOCUMENTS 8436 4/1911 United Kingdom ..... 281/15 R

*Primary Examiner*—Alexander S. Thomas
*Attorney, Agent, or Firm*—Wood, Herron & Evans

[57] ABSTRACT

Disclosed herein is a pad having a plurality of sheets adapted to remove undesirable particulate matter from surfaces to be cleaned, as for example, garments. The sheets contain an adhesive coating. The adhesive coating is protected prior to use by a protective cover sheet. The sheets can easily be disposed of after usage.

2 Claims, 2 Drawing Figures

PAD OF SHEETS FOR REMOVING PARTICULATE MATTER

BACKGROUND OF THE INVENTION

Various means have been devised for removing undesirable particulate matter from garments, as for example, hair, lint, threads, etc. Brushes have not proved to be entirely successful. Substrates having a sticky surface have been utilized. One such product is a roller which one rolls over the garment. The roller has a sticky surface to which the lint adheres. Used rolls are normally discarded after a period of use. Another prior art device which has been used is a mitt which one places over one's hand, removes a protective cover in the palm area of the mitt to expose a sticky surface which, like the roller, removes undesirable material which it is brought into contact with.

The prior art devices have suffered from various disadvantages, including cost, ease of use, ability to use the device, and the like.

It has been an important objective of this invention to provide a plurality of lint removing sheets that are placed together to form a pad and whereby individual sheets may be easily removed and disposed of and a sticky surface easily and quickly exposed whereby lint can be removed.

SUMMARY OF THE INVENTION

The pad of the present invention comprises in combination:

(1) a plurality of flexible sheets;
(2) an adhesive coating covering the top or bottom surface of each sheet;
(3) a plurality of flexible cover sheets which overlie the adhesive coating; and
(4) means to join the sheets together in pad form in such a manner that individual sheets may be removed from the pad and easily discarded.

DETAILED DESCRIPTION OF THE INVENTION

Figure 1:
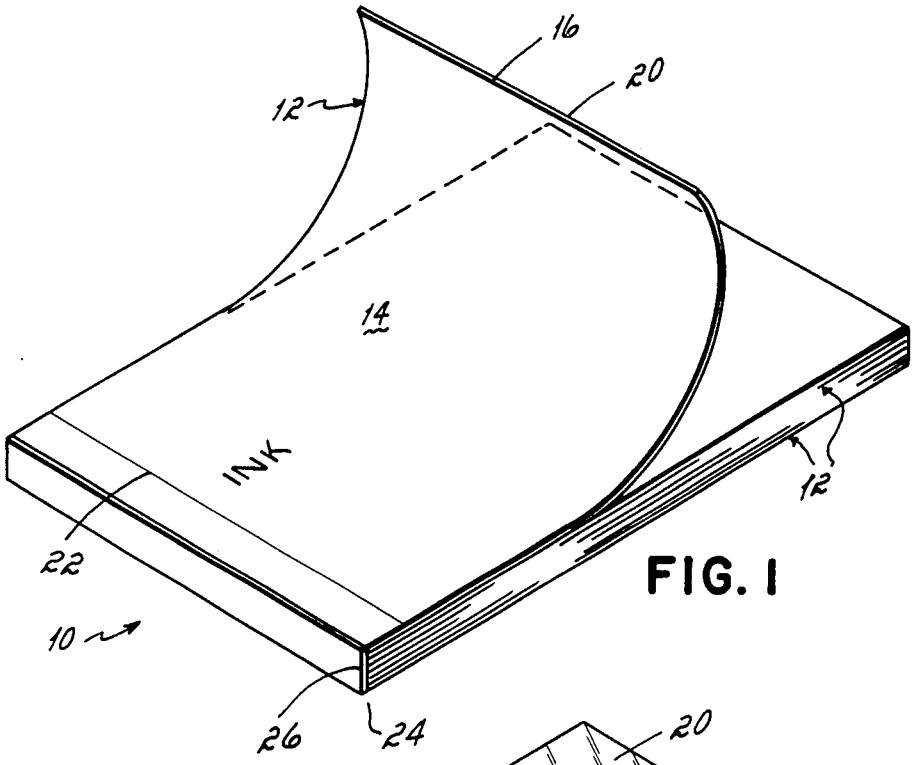
FIG. 1 is a perspective view showing a pad of lint removing sheets made in accordance with this invention with one sheet about to be removed.
Figure 2:
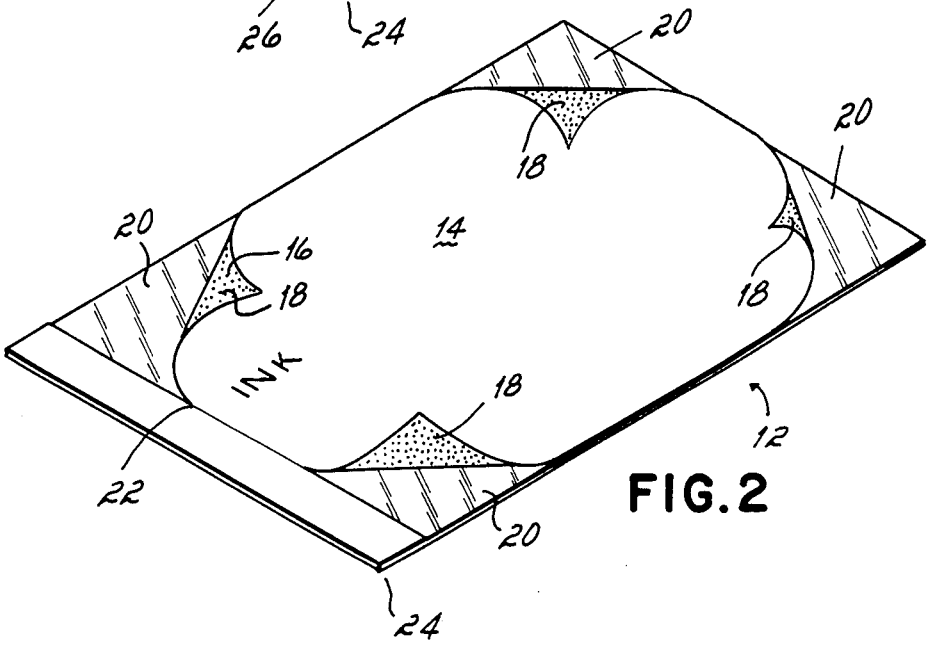
FIG. 2 is a perspective view illustrating a sheet removed from the pad of FIG. 1 with the adhesively coated flexible sheet about to be removed for use in removing undesirable particulate material.

Referring to FIGS. 1 and 2 there is disclosed a pad 10 of lint removing flexible sheets 12. In one preferred embodiment the sheets 12 are rectangular with a width of about 5" and a length of about 3½". They have a top surface 14 and a bottom surface 16. Since the pads 10 can be so economically manufactured they make excellent promotional, give away items for hotels, motels and the like. When so used it may be desirable to print the name of the hotel or other advertising information on the top surface 14. The flexible sheet 12 may be made from any suitable material. A suitable material is a mirror finish, cast coated white paper sold by The Fasson Company of Painesville, Ohio.

An adhesive coating 18 is coated onto the bottom surface 16 by any suitable means. Various conventional, well known adhesives can be employed. A suitable material is made from a styrene isoprene rubber with hydrocarbon tackifiers and aromatic/aliphatic oils. A suitable one is sold by Fasson under its code S-246. The adhesive is selected so that when adhesive is exposed it remains sticky or tacky whereby undesirable particulate material will become stuck to it when it is brought into contact with the material.

The adhesive coating 18 is protected prior to use by a protective cover sheet 20 made from any suitable material. A bleached sulphate, super-calendered stock, sold by Fasson under its trademark 40# Fastrip is suitable. The cover sheet 20 is of the same size and shape as the flexible sheet 12.

The protective cover sheet 20 is placed against the adhesive coating 18 and is thereby adhered thereto. However, due to the type of adhesive used in the adhesive coating 18, the flexible sheet 12 and the protective cover sheet 20 may be separated with the adhesive coating 18 remaining on the flexible sheet 12 in a sticky condition.

In order to be easily removable from the protective cover sheet 20, the flexible sheet 12 is scored across its width at 22 at one end by a kiss cut. Other scoring could be utilized to accomplish this purpose. By doing so the sheet may be easily removed from the pad 10.

A plurality of flexible sheets 12, with adhesive coatings 18, and protective sheets 20 are stacked on each other to form the pad 10. At one end 24 of the sheets 12 and 20 means for joining them together are used. While an adhesive layer 26 is shown, other suitable means could also be used.

In use, the flexible sheet 12 is removed from the protective sheet 20 and the bottom surface 16 with adhesive coating 18 brought into contact with lint, etc. on a garment. After use the flexible sheet 12 and the protective sheet 20 may be discarded. It can be seen that the provision of the sheets in pad form provides a simple, economical method of providing a number of sheets so that the user has a sufficient supply of the sheets. Yet, the pad 10 is small, compact, and easily stored or packed. The flexible sheet 12 is easily removed because of the kiss cut at 22.

I claim:

1. A pad of sheets for removing undesirable particulate matter from a surface to be cleaned, said pad comprising in combination:

(a) a plurality of individual flexible sheets capable of accepting an adhesive coating, said individual flexible sheets each having four edges wherein a line is scored onto said individual flexible sheet along a length parallel to an edge and spaced inward therefrom;
(b) an adhesive coating covering the entire surface of one side of each flexible sheet which preferentially binds to said flexible sheet and which removes undesirable particulate matter upon contacting a surface to be cleaned;
(c) a cover sheet which covers and protects said adhesive coating on each flexible sheet from undesired contact prior to use, said cover sheet capable of being separated from said adhesive coating without disrupting said adhesive coating; and
(d) adhesive means, along the aforementioned edge of the pad, for joining said flexible sheets and cover sheets together to form a pad and which adhesive means permit a single flexible sheet to be easily removed from the pad and cover sheet.

2. The article of claim 1 wherein said cover sheet is capable of accepting ink.

* * * * *